United States Patent [19]

Fawcett et al.

[11] 4,197,715

[45] * Apr. 15, 1980

[54] HEAT PUMP

[75] Inventors: Sherwood L. Fawcett, Columbus; James N. Anno, Cincinnati, both of Ohio

[73] Assignee: Battelle Development Corporation, Columbus, Ohio

[ * ] Notice: The portion of the term of this patent subsequent to Oct. 3, 1995, has been disclaimed.

[21] Appl. No.: 918,234

[22] Filed: Jun. 23, 1978

Related U.S. Application Data

[63] Continuation-in-part of Ser. No. 812,559, Jul. 5, 1977, Pat. No. 4,117,696.

[51] Int. Cl.[2] ..... F25B 1/00; F25B 13/00

[52] U.S. Cl. ..... 62/115; 62/324; 60/325; 418/33; 62/467 R

[58] Field of Search ..... 62/115, 324 B, 325, 62/401, 402, 116, 467; 60/325; 418/33; 290/1 R

[56] References Cited

U.S. PATENT DOCUMENTS

| | | | |
|---|---|---|---|
| 3,859,789 | 1/1975 | Fawcett et al. | 60/325 |
| 3,927,329 | 12/1975 | Fawcett et al. | 418/33 |

*Primary Examiner*—Lloyd L. King

*Attorney, Agent, or Firm*—Thomas H. Murray; Clifford A. Poff

[57] ABSTRACT

Heat pump apparatus employing a continuous loop passageway containing a plurality of freely-movable, unrestrained bodies. The bodies are accelerated around the passageway in one direction by adiabatic expansion of a fluid between the bodies in an expander region of the passageway. The expanded, cooler fluid is discharged from the passageway via one or more vent-intake ports in the passageway beyond the expander region. Warmer fluid enters the passageway via said ports and is compressed between the propelled bodies in a compression region of the passageway, thereby raising its temperature from a first temperature (e.g., the temperature of the outdoor atmosphere or an industrial waste heat stream) to a second temperature higher than the first. The compressed, warmer fluid is thereafter passed through a heat exchanger to extract heat. In passing through the compression region the bodies are decelerated and they then pass through a thruster region of the passageway wherein a force is applied to the bodies to counterbalance the external forces acting against the bodies as they move around the loop passageway. From the thruster region the bodies pass to the expander region to repeat the cycle. From the heat exchanger the fluid, typically together with additional compressed fluid from an external source, is introduced into the expander region to again accelerate the bodies.

34 Claims, 7 Drawing Figures

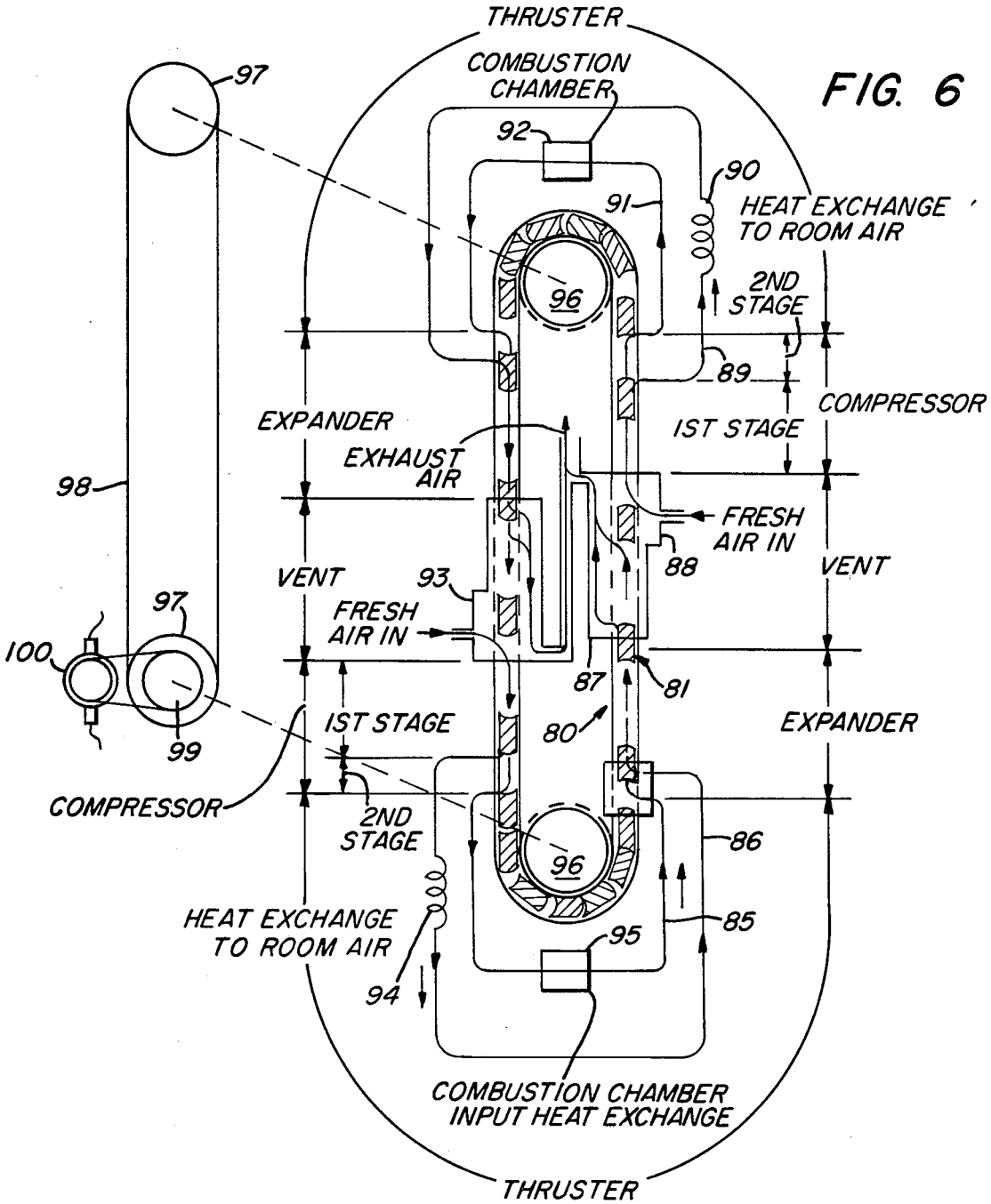
FIG. 7
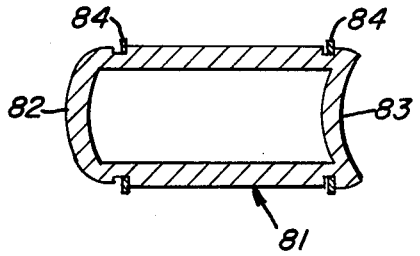

HEAT PUMP

CROSS-REFERENCE TO RELATED APPLICATION

This application is a continuation-in-part of application Ser. No. 812,559, filed July 5, 1977, now U.S. Pat. No. 4,117,696.

BACKGROUND OF THE INVENTION

As is known, the usual heat pump used to heat buildings, for example, includes an electrically-driven compressor, a throttling valve, an evaporator located in the ambient atmosphere outside the building, and a condenser within the building which discharges heat as a refrigerant is condensed. Such systems are relatively complicated, have low coefficients of performance based upon actual thermal conversion and, of course, require a liquid refrigerant which tends to be expensive and may have toxic properties. Furthermore, the energy input into the system is usually electrical and, hence, does not utilize the heat rejected in the electrical energy production.

SUMMARY OF THE INVENTION

In accordance with the present invention, a heat pump is provided which can be used with a heat source (such as natural gas, oil or coal), or a motor-driven compressor and which can operate on simple fluids such as air in contrast to the more expensive and toxic refrigerants used in conventional prior art heat pumps. At the same time, the heat pump of the invention is of relatively simple construction and has a high coefficient of performance.

The invention is based on certain of the principles set forth in Fawcett et al U.S. Pat. No. 3,859,789 directed to a unidirectional energy converter wherein bodies movable around a continuous loop passageway are utilized to convert one form of energy to another form of energy. In contrast to the apparatus shown in U.S. Pat. No. 3,859,789, however, the purpose of the present invention is to increase the heat content, and therefore, the temperature, of a fluid such as air at one location and decrease it at another. That is, the apparatus is used to move or "pump" heat from a reservoir at a colder temperature (for example, the outdoor air or a waste heat stream) to a reservoir at a warmer temperature (for example, the indoor air or a process heat stream). When used for cooling purposes, the reservoirs are simply reversed with the heat pump taking heat from the cooler indoors and exhausting it to the warmer outdoors as in a conventional air-conditioning system.

Specifically, in accordance with the invention, there is provided a continuous loop passageway containing a plurality of freely-movable, unrestrained bodies. A source of compressible fluid (e.g., air or a liquefiable vapor such as Freon, etc.) under pressure is provided for generating a force to accelerate successive ones of the bodies in one direction around the passageway. Energy transfer takes place in which process adiabatic expansion of the fluid is used to impart kinetic energy to the bodies. In a region in the passageway beyond the region in which fluid expansion takes place (i.e., the expander region), ports are provided to permit the exhaust of the very cool working fluid and entrance of a warmer charge of fluid such as outdoor air. In a closed system (e.g., Freon, etc. fluid), these ports are simply connected to an in-line heat exchanger. Following these ports is a compression region in the passageway wherein the fluid is compressed between successive ones of the propelled bodies. In this region, energy transfer takes place in which process the kinetic energy of the bodies is used to adiabatically compress the fluid. The compressed fluid is removed from the passageway and passed through an optional, but preferred, check valve and then through heat exchanger means connected to the passageway at the end of the compression region for extracting heat from the fluid thus compressed. An optional, but preferred, latch extends into the passageway at the end of the compression region to prevent backward motion of the bodies. The cooled compression fluid is reintroduced into the passageway together with an additional charge of compressed fluid from the external compressor to repeat the cycle.

The above and other objects and features of the invention will become apparent from the following detailed description taken in connection with the accompanying drawings which form a part of this specification, and in which:

FIG. 6 is a simplified schematic diagram of unidirectional energy converter devices forming a compound heat engine and heat pump according to a further embodiment of the present invention; and FIG. 7 is an illustration of a further form of an unrestrained body which is particularly useful in the embodiment of the invention shown in FIG. 6.

Figure 1:
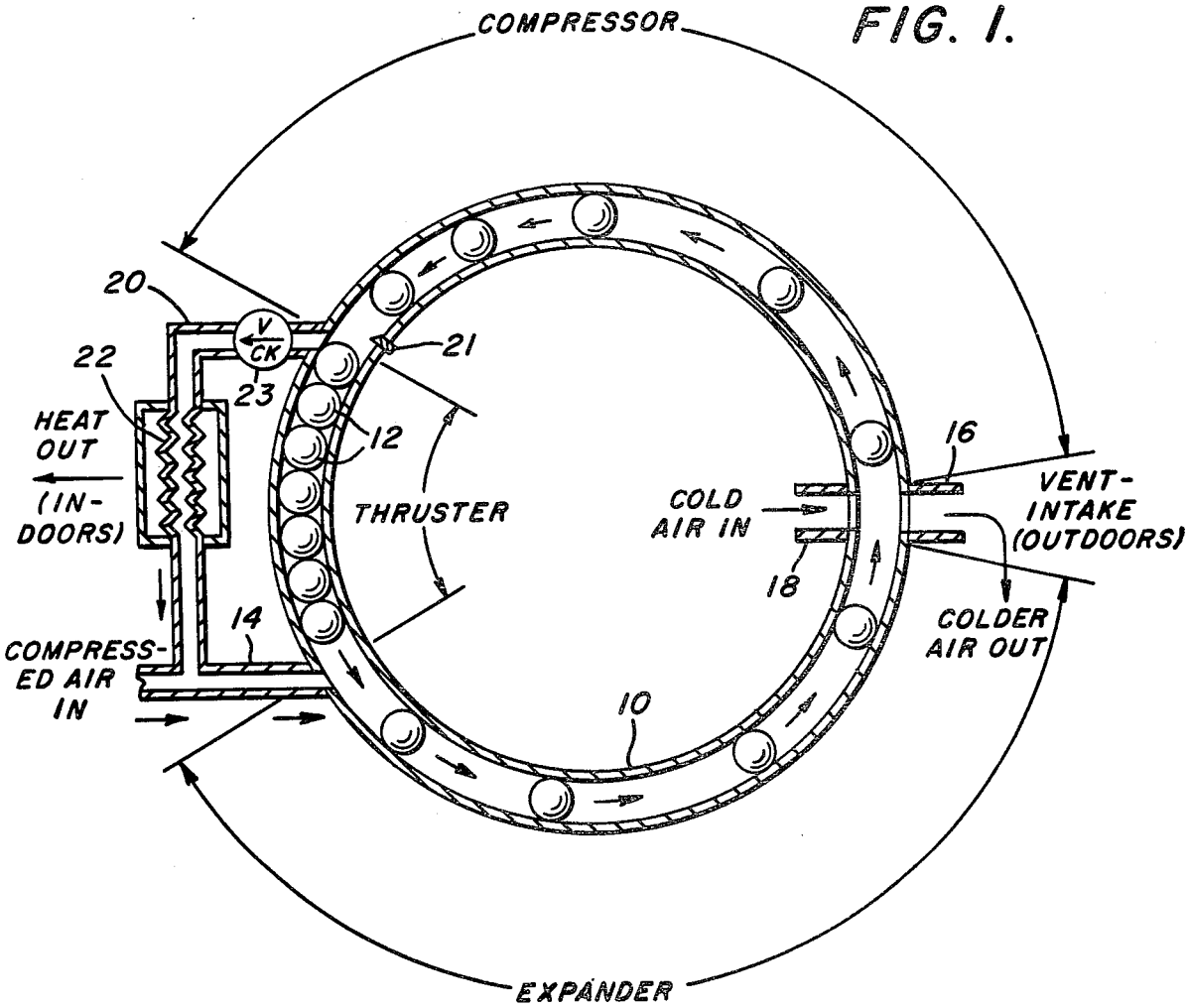
FIG. 1 is a simplified schematic diagram of the unidirectional energy converter heat pump of the invention.
Figure 2:
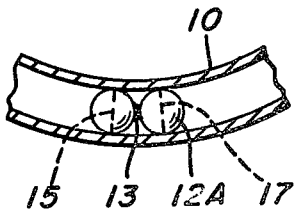
FIG. 2 is an illustration of an alternative form of unrestrained bodies which can be used in the heat pump of the invention.

With reference now to the drawings, and particularly to FIG. 1, the apparatus shown includes a closed-loop passageway 10 defined by a housing having walls which are preferably smooth and formed from metal. Disposed within the passageway 10 is a plurality of pistons 12, shown in the embodiment of FIG. 1 as solid spheroids. The tolerances or clearances between the surfaces of the spheroids and the inside walls of the passageway 10 are such as to permit the spheroids to move freely along the passageway 10. However, fluid flow past the spheroids within the passageway is substantially prevented. In the embodiment shown in FIG. 1, for example, the loop passageway 10 has a circular cross section, but with other shaped bodies, other cross sections may be utilized including elliptical or polygonal cross sections. In some cases, it is advantageous to weld two spheroids together as shown in FIG. 2. The body 12A, comprising two spheroids welded at 13, now has two circumferential lines of contact 15 and 17 with the inside walls of the passageway 10. This arrangement does not impede the movement of the body, but increases the sealing effect between the body and the interior wall. At the same time, it decreases the chances of having the spheroids pit the interior wall surface of the passageway in those embodiments of the invention where a sharp bend occurs in the passageway and, further, reduces clearance problems due to deformations of the spheroids from impacts.

As shown in FIG. 1, the continuous loop passageway 10 is divided into sections. In an expander section, compressed air from a suitable compressor, not shown, enters the passageway 10 through conduit 14. This causes successive ones of the bodies 12 to be propelled around the passageway 10 in a counterclockwise direction as viewed in FIG. 1. That is, the compressed air from conduit 14 along with compressed air from heat exchanger 22, as described below, enters the passageway 10 and expands adiabatically imparting kinetic energy in the form of increased forward velocity to each body 12 while the gas between successive ones of the bodies is reduced in temperature. As the bodies pass port 16 connected to the passageway 10, the cooler air which has been adiabatically expanded exits to the atmosphere and air from the ambient atmosphere enters the passageway through port 18 and is thereafter compressed in a compression region of the passageway. If a liquefiable vapor, rather than air, is used, or if for any other reason it is desired to maintain a closed system, the ports may be arranged and connected to conventional heat exchanger means (not shown) in any known manner. In a typical embodiment of the invention, a plurality of ports 16 and 18 is provided. The kinetic energy of the moving bodies is used to compress the gas entering at port 18, and the compressed gas exits from the passageway 10 through conduit 20 connected to one side of a heat exchanger 22 via check valve 23. In the compression process, the temperature of the air is, of course, increased as well as its heat content. Part of the heat is extracted by means of the heat exchanger 22. The gas which passes through the heat exchanger 22 is then combined in conduit 14 with the compressed air from an external source (not shown) to propel the bodies 12 in the expander section.

Another optional, but preferred, feature of the invention comprises latch means 21 located at or near the end of the compression region and adapted to prevent backward motion of the bodies in this region after their kinetic energy has been reduced. Any conventional latch means may be used, such as, for example, a spring-powered, beveled latch 21 (spring not shown) operating in a manner similar to an ordinary door latch. That is, the latch projects slightly into the passageway 10 and is beveled in the direction of approach of the bodies so that as each body comes into contact with the latch in a counterclockwise direction it will depress the latch allowing it to pass, but the latch will not depress to allow the bodies to retreat in a clockwise direction.

Figure 3:
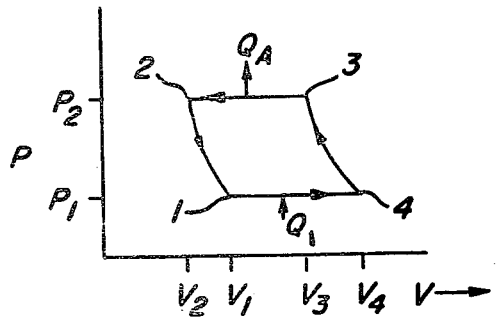
FIG. 3 is a P-V diagram showing the thermodynamic cycle of the apparatus of FIG. 1.

One possible thermodynamic cycle used in the heat pump of the invention is shown in FIG. 3 and is similar to a Brayton cycle. Between successive ones of the bodies there is what can be termed a unit cell. Gas enters the expander section from conduit 14. The unit cell between successive bodies in the expander section then seals off the inlet conduit 14 and adiabatically expands between points 2 and 1 in FIG. 3 to a pressure $P_1$ and volume $V_1$ at temperature $T_1$. For simplicity, it will be assumed that the pressure $P_1$ is atmospheric pressure. The velocity of the lead body 12 is now $v_1$, its maximum value.

The residual gas, whose temperature has been reduced to $T_1$ in the adiabatic expansion, is then purged through port 16 and ambient air at a higher temperature enters through port 18 and occupies the unit volume between successive spheroids. Thus, heat is absorbed in this process from the cold reservoir (e.g., outdoor air). The actual volume between the spheroids remains essentially constant during this operation, but the specific volume increases to $V_4$ between points 1 and 4 in FIG. 3. In other words, less mass of gas enters the loop through port 18 in each unit cell than was exhausted from the unit cells via port 16. This difference in mass is made up by the additional air which enters the system from the external compressor via conduit 14.

The fresh charge of gas is then compressed adiabatically between points 4 and 3 in FIG. 3 to volume $V_3$ at temperature $T_3$ and pressure $P_2$. The pressurized heated gas is then exhausted from the compressor section via conduit 20 through check valve 23, and heat is extracted through the heat exchanger 22. The unit cell collapses and the cycle is then repeated, the total work being represented by the area within the lines between points 1, 2, 3 and 4 in FIG. 3.

Figure 4:
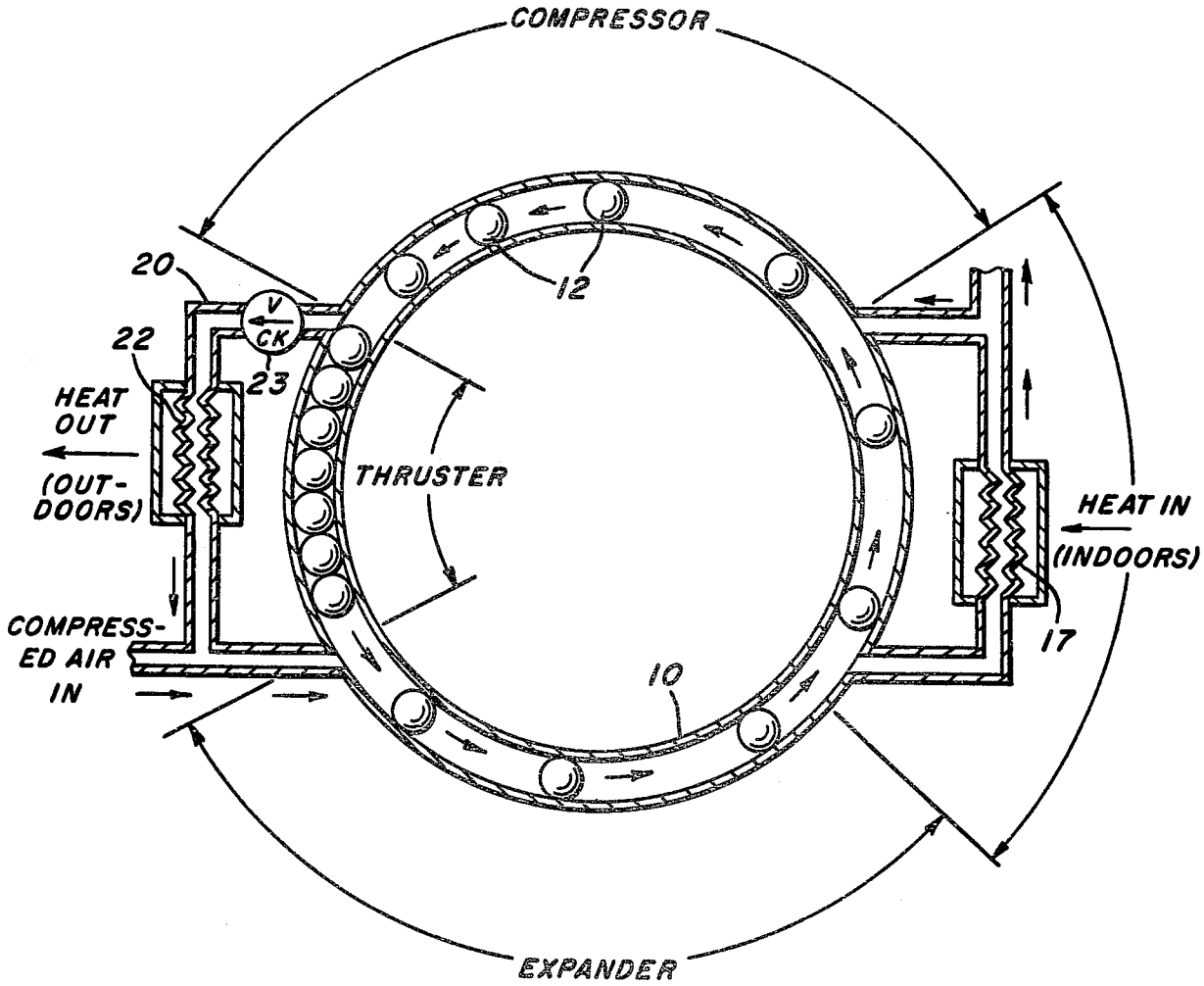
FIG. 4 is a simplified schematic diagram of the unidirectional energy converter heat pump of the invention shown in a cooling (i.e., air conditioning) mode.

The air-conditioning (i.e., cooling) mode of operation of the heat pump is shown in FIG. 4. The system is essentially the same as that of FIG. 1 and, accordingly, elements in FIG. 4 which correspond to those of FIG. 1 are identified by like reference numerals. In this case, port 16 corresponds to the cool air duct of an air-conditioning system; whereas port 18 corresponds to the warm return. As an optional feature, heat exchanger means 17 may be connected to ports 16 and 18, necessitating a slight rearrangement of these ports as shown. The heat exchanger 22, in an air-conditioning system, will be located external to the building which is being cooled and would correspond to a conventional condensing coil in a refrigeration system. The same basic thermodynamic cycle shown in FIG. 3 is employed; however cycles other than the Brayton refrigeration cycle are also possible.

In the air-conditioning mode between points 2 and 1 in FIG. 3, the expander region takes air from the outdoor heat exchanger 22 and adiabatically expands it to a temperature lower than the indoor temperature. The cooler air is exhausted into the indoors through exit port 16; or it can be passed through an indoor heat exchanger. Between points 1 and 4 of FIG. 3, the unit cell picks up a charge of warmer indoor air ($Q_1$). Between points 4 and 3, this warmer air is adiabatically compressed to a higher pressure and temperature; and between points 2 and 3, the heat is exhausted to the outdoors at constant pressure via the heat exchanger 22 ($Q_A$). The net work to drive the cycle is provided by make-up air from an air compressor, not shown, passing into the expander section through conduit 14. The difference between the cooling and heating modes is, of course, that in the heating mode, heat is taken from outdoors and pumped indoors; whereas in the cooling mode, heat is taken from the indoors and pumped outdoors.

Figure 5:
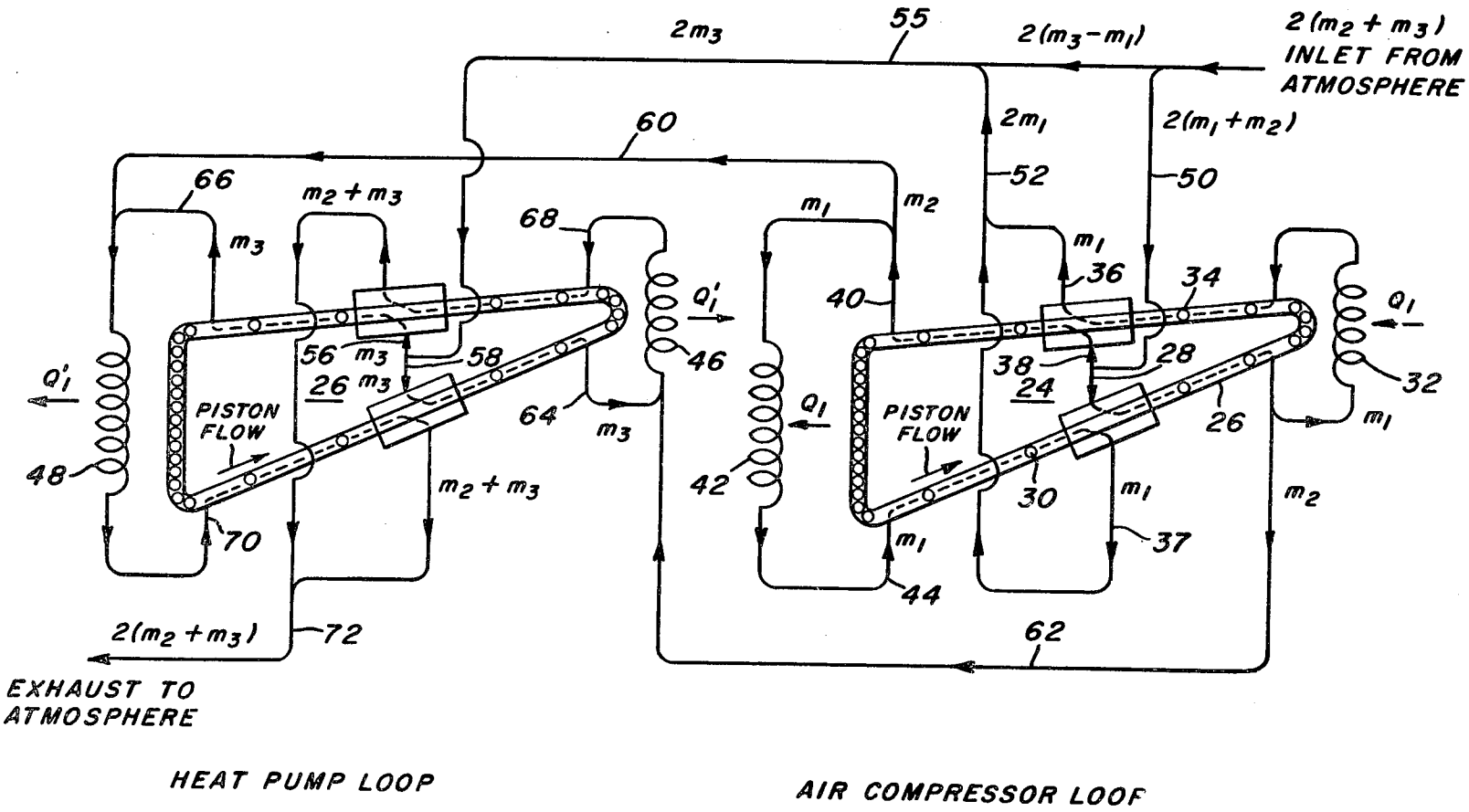
FIG. 5 is an illustration of an embodiment of the invention employing two double unidirectional energy converter devices, one of which is used as an air compressor and the other of which is used as a heat pump.

In FIG. 5, an embodiment of the invention is shown wherein unidirectional energy converters are employed both as the heat pump and as the air compressor designed to supply compressed air to the heat pump. In FIG. 5, the air compressor loop is indicated generally by the reference numeral 24 and the heat pump loop by the numeral 26. Each of the loop subsystems 24 and 26 incorporates two unidirectional energy converters in series.

The air compressor loop 24 operates as follows. One portion of atmospheric air ($m_1+m_2$) enters the lower leg 26 of the loop at 28 via conduit 50 and then is compressed as the pistons or bodies 30 move upwardly in the leg 26. Part of the compressed gas exiting from the top of the leg 26, $m_1$, passes through a heat exchanger 32 where heat is added from an external heat source $Q_1$. This source may, for example, comprise burning natural gas or any other suitable source of heat. The heated, compressed gas is used in an upper leg 34 to propel the bodies 30 to the left by adiabatic expansion. After it has been adiabatically expanded, and reduced in temperaure, in leg 34, the gas, $m_1$, exits at 36; while a new charge of atmospheric air ($m_1+m_2$) enters at 38 where it is compressed by the propelled bodies 30 and exits at 40. Part of the compressed gas, $m_1$, is passed through a heat exchanger 42 where heat is added, as described above, the resulting compressed and heated gas being reintroduced into the lower leg 26 at 44 where it adiabatically expands to propel the bodies 30 to the right. After it has been adiabatically expanded, and reduced in temperature, in leg 26, the gas, $m_1$, exits at 37. The two portions ($2m_1$), comprising the adiabatically expanded gas, are then combined in conduit 52, with additional atmospheric air, $2(m_3-m_1)$, being added in conduit 55 to yield a quantity of gas of $2m_3$. One-half of this quantity, or $m_3$, then enters the input 56 and the remaining half, $m_3$, enters input 58, the respective inputs of the two compressor sections of the heat pump loop 26.

It will be noted that the two individual portions $m_2$ of the compressed and heated gas which exit from the air compressor loop 24 are passed through conduits 60 and 62, respectively, to the heat exchangers 48 and 46, respectively, in the heat pump loop 26. In the heat pump loop these two portions of gas $m_2$ are individually combined with the two respective compressed gas portions $m_3$ exiting from the two respective compressor sections at 66 and 64. The heat exchangers 46 and 48 can be of the finned-tube type through which air is blown by means of a fan to heat the air within a building to a temperature much higher than the atmospheric air initially entering the system, the heat emanating from the heat exchangers being indicated by the arrows $Q'_1$ in FIG. 5. The portion ($m_2+m_3$) passing through the heat exchanger 46 is again introduced into the loop 26 at 68 to propel the bodies 30 by adiabatic expansion; and that portion ($m_2+m_3$) passing through heat exchanger 48 is fed back into the loop at 70 to adiabatically expand and propel the bodies forwardly in the lower leg of the loop 26. The two portions of adiabatically expanded gas, $2(m_2+m_3)$, of reduced temperature are then exhausted through conduit 72 to the atmosphere; or can be passed through an additional heat exchanger located within a building when the system is used as an air-conditioning system. In the latter case, the heat exchangers 46 and 48 will, of course, be located outside the building.

As the fluid is compressed by the freely-movable bodies in the compressor sections, most of the kinetic energy of each body is transferred to increase the enthalpy of the gas and to remove the gas from the compressor section under increased pressure. Similarly, as the fluid in the expander sections of the loop is adiabatically expanded between successive bodies in the expander sections, the enthalpy of gas is decreased and energy is transferred to increase the kinetic energy of the bodies. The energy transferred in the various processes around the loop, of course, must be conserved so that at any time the total energy of a particular loop system is constant and the energy input and output is equal in steady-state operation.

The thermodynamics of the expander and compressor sections of the heat pump of the present invention can be analyzed from ideal considerations as undergoing isentropic processes. However, in actual operation, because of internal losses to the working fluid, the processes are not precisely isentropic. The processes take place, very nearly, as adiabatic processes, i.e., with no external heat losses, particularly when adequate and and properly arranged insulation is attached to the outer walls of the passageway forming the expander and compressor sections. Thus, while isentropic operation might be assumed for the purpose of analysis, nevertheless the actual operating processes of the heat pump are better described as adiabatic.

In a similar fashion, the total external forces acting on the freely-movable bodies as they move around the loop must integrate to zero over time period for a particular body to completely transit the loop system under steady-state operation. This is simply in accordance with Newton's second law of motion. Since the movable bodies will encounter friction forces opposing the direction of motion around the loop, these friction forces must be counterbalanced by some external force acting in the direction of motion. If the loop passageway around which the bodies travel is in a vertical, or near vertical, plane, such as shown, for example, in the embodiment of FIGS. 1 and 5, the force of gravity can be used to provide at least part of the thrust to counterbalance the friction forces. If the loop passagway must be in a horizontal plane, alternative external thruster forces may be applied to the bodies to counterbalance the frictional forces. For example, mechanically-powered devices such as cams, sprocket wheels, or worm gears, or a linear magnetic motor may be used.

The number of bodies used in the heat pump of this invention, the length of the various regions (i.e., expander and compressor) of the closed passageway and the total length of the closed-loop passageways are constants for a particular heat pump design. This means that the control system of the compressor and heat pump loops must regulate the operating parameters to maintain approximately constant distribution of pistons around the loop for all operating levels.

As will be appreciated, the invention has great flexibility in design and performance in that it can be constructed in a continuum of sizes for heating or cooling capability. Furthermore, it can be constructed as a multipleunit system in which various of the units can be turned ON or OFF as the load requires. This also aids reliability since if one of the units should fail, the system is still operable.

The system employs conduits, pistons or movable bodies, simple check valves, latches, and heat exchangers which should contribute greatly to reliability and economy for home heating and cooling systems presently utilized in natural gas or oil heating.

It is also possible to use the invention in an arrangement in which the external compressor is replaced by a "pressurizer" which is an in-line component of the heat pump loop system between the compressor and expander regions. In this mode of operation, the apparatus would be designed to take in the same mass flow rate of gas as it exhaust in the vent-intake region, but consequently would compress to a lower pressure than required at the expander inlet. The role of the pressurizer, then, is to pressure the gas sufficiently to make up this difference using any known method for pressurizing.

The energy input to the pressurizer is the energy source for running the heat pump, as will be understood.

In a typical installation, the overall length of the heat pump loop shown in FIG. 5, for example, will be about thirty-four times the diameter of the bodies 30; while the overall length of the air compressor loop will be about twenty-seven times the diameter of the bodies 30.

In FIG. 6, a further embodiment of the invention is shown wherein serially-arranged unidirectional energy converters form a compound heat engine and heat pump. The heat engine uses a high pressure stage to convert heat energy into net mechanical energy which is then converted in a low pressure stage of the heat pump to heat energy. More specifically, the unidirectional energy converter according to the embodiment shown in FIG. 6 is comprised of two heat engines and two heat pumps operating in parallel. A "racetrack" shaped tubular passageway extends within a vertical plane to form a continuous loop passageway 80 containing a plurality of pistons 81. The pistons 81 may be spheroids or other desired configuration but preferably the pistons take the form as shown in FIG. 7, of hollowed members having a cylindrical configuration with sperical end surfaces. The leading end surface 82, in regard to the direction of travel by a piston, is convex; whereas the trailing end 83 of the piston is concave. Piston rings 84 are located in recesses formed within the outer cylindrical surface of the piston adjacent the convex cylindrical end 82 and the concave cylindrical end 83. The hollow design of the pistons provides the necessary design mass and permits greater flexibility to the selection of material for the construction of the pistons independent of the mass required for design operation. The pistons rings, which are lightly loaded, reduce losses to a minimum due to leakage of the fluid medium around the pistons. Also, the use of rings places less stringent manufacturing tolerances for the production of the pistons. The pistons freely move within the passageway 80 and operate under light loads, particularly as compared to the loads imposed on the pistons of an internal combustion engine. The maximum velocity of the pistons 81 is typically the same as the velocity of pistons in an internal combustion engine. A thin film of oil such as, for example, SAE 20 or molybdenum disulfide dry powder may be used, if desired, for lubrication between the pistons and the raceway since the fluid temperature does not exceed 1500° F. and usually does not exceed 1200° F.

As is shown in FIG. 6, the continuous loop passageway 80 is divided into regions. In an expander region, hot compressed air enters the passageway 80 through an entry port coupled to a conduit 85 whereby each piston is accelerated, in succession, upwardly through the lower right quadrant of the passageway. When a second piston passes the entry port for conduit 85, a portion of the hot air is closed off from the source, thus forming a unit cell of hot compressed air. The hot compressed air in the unit cell is expanded adiabatically until the leading piston passes a point in the passageway containing an entry port coupled with conduit line 86. As the leading piston passes this entry port, more compressed air at a lower entry temperature and pressure is fed into the unit cell between the piston from conduit line 86. The combined compressed air of the unit cell is further expanded adiabatically until the leading piston passes an exit port communicating with an exhaust manifold 87 in a vent region. The region of the raceway between the entrance port for conduit 85 and the exit port for the exhaust manifold 87 forms an expander region of the passageway wherein energy of the hot compressed air from conduits 85 and 86 is converted to kinetic energy of the pistons. The exhaust manifold coextends with the vent region wherein cold air is purged from each unit cell between the pistons in the passageway and replaced by fresh air fed through an entry port by a manifold 88 from the outside. The manifolds 87 and 88 in the vent section terminate at the beginning portion of a compression region where the fresh air in the unit cell between pistons is compressed abiabatically by the kinetic energy of the pistons.

The compression region has two stages in series. The largest portion and first of the compression stages extends to a discharge port for a conduit 89. The largest portion of the air that is compressed between the pistons is passed from the unit cell through conduit 89 into heat exchanger 90 where the compressed air is cooled by heat exchange with room air. From the heat exchanger, the cooled compressed air is reintroduced by conduit 89 into the passageway through a port in the second expander region where the air is further cooled adiabatically in a unit cell and exhausted to the atmosphere below atmospheric temperature.

Returning, now, to the compressor region, the second stage thereof utilizes the remaining kinetic energy of the pistons to further compress a small quantity of air remaining in the unit cell. The second stage of the compressor region terminates at a port for a conduit 91 to deliver the compressed air from the second stage into a combustion chamber 92 where the compressed air is heated and then fed by conduit 91 to reenter the passageway through a port at the entrance of the second expander region. Unit cells of air are formed between the pistons after the pistons are passed through a thruster section wherein their direction of travel is altered, and thereafter the pistons pass downwardly along the passageway. The downward path of travel by the pistons is accompanied by the formation of unit cells therebetween while the pistons pass along a second expander region, second vent region and second compression region that are essentially duplicates as far as function is concerned to the corresponding regions already described above. The unit cells formed between the pistons during their downward travel along the passageway are supplied with heated compressed air from conduit 91 and supplied with further quantities of compressed air from conduit 89. As the leading piston of a unit cell passes from the expander section and enters the vent section, the hot compressed air is expanded adiabatically whereupon the heat energy of the air is converted to kinetic energy of the pistons. The lower, successively-arranged vent region includes a manifold 93 wherein cold air is purged from the unit cell between pistons while the space between the pistons is replenished with fresh air from outside.

As shown in FIG. 6, for convenience, manifolds 87 and 93 communicate with a common duct to exhaust the cold air to the atmosphere. The temperature of the exhaust cold air is below atmospheric temperature. Below the vent region formed by manifold 93 is the second compression region consisting of two stages, the first of which terminates at an exit port for conduit 86 coupled to a heat exchanger 94 to exchange heat with room air. The second stage of the compression region extends between the exit port for conduit 86 and an exit port for conduit 85. The remaining kinetic energy of the pistons is utilized to further compress a small quantity of air remaining in the unit cell. The remaining air in the unit cell is fed by conduit 85 to a combustion chamber 95. Combustion chamber 95 functions in the same manner as combustion chamber 92 by reheating the heated compressed air for delivery by conduit 85 into the lower portion of the expander region to form a unit cell between pistons for their upward travel along passageway 80. Thus, in this manner the cycle is repeated with the pistons traveling upwardly against the force of gravity along the vent and compressor regions at one side of the vertically-arranged passageway. A parallelly-arranged heat engine and heat pump is formed by the expander, vent and compressor regions at the opposite vertical side of the passageway where the piston travels downwardly under the force of gravity. Thruster regions which take the form of U-shaped passageway sections feed the pistons at the discharge side of the compression regions through the use of sprocket wheels or the like into the entry side of the expander regions. The thruster regions function to provide a net external force to the pistons in their direction of motion around the passageway to equalize the forces due to friction which act to oppose the piston motion.

It is now apparent that the unidirectional energy conversion loop described above is a compound heat engine and heat pump, thermodynamically a double Brayton cycle. The high-pressure states, i.e., the expander regions, convert heat energy into a net mechanical energy that drives the reverse Brayton cycle of a low-pressure stage, i.e., the compressor regions, as a heat pump. The compound heat engine and heat pump of this embodiment offers a system wherein the working fluid conveniently takes the form of air throughout the system, thus providing ecomomy, simplicity and environmental cleanliness. The straight vertical portions of the passageway conduct the pistons while traveling at their highest velocity, thus minimizing the forces and frictional losses that would otherwise adversely affect travel of the pistons. The porting of air or other fluid medium used in the system is performed preferably by the pistons, thus reducing the number and complexity of in-line valves for the conduit.

The thruster regions in the schematic illustration include means for conducting the piston about the U-shaped configuration of the passageway at the ends of the vertical portions thereof. While the U-shaped configuration to the passageway can be readily designed to utilize gravity to guide the pistons about their reverse direction of travel, it is nevertheless preferred to provide means such as a sprocket wheel, a linear electromagnetic drive or a linear latch system to insure movement of the pistons throughout the thruster regions. In FIG. 6, a sprocket wheel 96 is shown at both thruster regions to conduct the pistons therealong. Each thruster wheel is coupled by a drive shaft to a pulley 97. The pulleys are interconnected by a timing belt 98. One of the pulleys 97 includes a second pulley section 99 coupled by a belt to a pulley on the output shaft of a suitable motor 100. This form of drive system provides synchronization between both sprocket wheels 96. The motor 100 is preferably a constant speed motor which may be coupled, as an alternative to a belt drive system, by a drive shaft through bevel gears on arbors for the sprocket wheel.

The heat exchangers 90 and 94 are typically counterflow air-to-air exchangers. Heat exchangers of the state-of-the-art construction are capable of accommodating at the high temperature side at maximum temperatures of several hundred degrees Fahrenheit. The combustion chambers 92 and 95 may typically take the form of a chamber for the direct combustion of compressed natural gas with the working compressed air or, alternatively, a conventional gas-fired furnace may be utilized. Other conventional external heat sources may also be employed. However, when a direct combustion chamber is utilized, the heat of combustion is completely utilized by the heat pump and gases will be exhausted at subatmospheric temperatures. While, as described hereinbefore, the pistons form necessary valving at ports for the conduits, it may nevertheless be desirable to incorporate check valves at compressor outlets to minimize a backflow of air in part of the cycle. High frequency of response and low pressure drop characteristics are important criteria for selecting such check valves. Reed valves are suitable to form such check valves.

A back latch mechanism for the pistons may be conveniently used for start-up and shutdown operations of the heat engine and heat pump. At shutdown, it is necessary that the pistons come to rest and remain at predetermined positions so that they will be in the proper position for smooth start-up. This can be achieved by magnetically-operated latches which are actuated at shutdown and retract at start-up. Moreover, at start-up, an air compressor or accumulator may be utilized for the start-up operation.

A vertically-arranged loop passageway 80 has been shown in FIG. 6 and described above solely for convenience of description. Other variations in the arrangement of the passageway, including horizontal arrangement, are possible.

Although the invention has been shown in connection with certain specific embodiments, it will be readily apparent to those skilled in the art that various changes in form and arrangement of parts may be made to suit requirements without departing from the spirit and scope of the invention.

We claim as our invention:

1. Heat pump apparatus comprising:

(a) a continuous loop passageway containing a plurality of bodies to move along the passageway, (b) means for generating a force by the expansion of a fluid in an expander region of said passageway to thereby accelerate successive ones of the bodies in one direction around the passageway, (c) a compression region in the passageway beyond the expander region wherein fluid is compressed between successive ones of the propelled bodies, (d) port means in the passageway between the end of the expander region and the beginning of the compression region to permit the venting of fluid which has been expanded and the entrance of fluid which is to be compressed, (e) a thruster region in the passageway beyond the compression region wherein a force is applied to successive ones of the bodies to counterbalance the external forces acting against the bodies as they traverse the loop passageway and to return them from the end of the compression region to the beginning of the expander region, and (f) heat exchanger means having its entrance connected to the passageway at the end of the compression region to extract heat from the compressed fluid leaving the compression region.

2. The heat pump apparatus of claim 1 wherein said fluid entering said port means comprises the ambient air external to a building, and said heat exchanger means is disposed within the building.

3. The heat pump apparatus of claim 1 wherein each of said bodies is of a shape that is substantially complementary to the cross-sectional shape of said continuous loop passageway so as to substantially seal the passageway from fluid flow around said bodies and subdivide said fluid between said bodies into separate units.

4. The heat pump apparatus of claim 1 wherein said continuous loop passageway includes a first expander region, first port means, a first compression region, a first thruster region, and a first heat exchanger means, a second expander region, second port means, a second compression region, a second thruster region, and a second heat exchanger means, said first and second recited elements forming heat pumps connected in series in a single continuous loop passageway containing said plurality of freely-movable, unrestrained bodies.

5. The heat pump apparatus of claim 1 wherein said heat exchanger means has its exit connected to the passageway in the expander region to introduce fluid into the expander region from the heat exchanger means.

6. The heat pump apparatus of claim 5 including second heat exchanger means, and means for directing fluid from which heat has been extracted by expansion through said second heat exchanger means to cool the ambient atmosphere.

7. The heat pump apparatus of claim 1 wherein said means for generating a force comprises compressed gas from a compressor means, which gas is expanded in said expander region.

8. The heat pump apparatus of claim 7 wherein said compressor means comprises apparatus for adding heat to a given volume of said gas.

9. The heat pump apparatus of claim 7 wherein compressed gas is combined with gas passing through said heat exchanger means and thereafter introduced into said continuous loop passageway for expansion in said expander region.

10. The heat pump apparatus of claim 14 wherein said compressor means comprises a second continuous loop passageway containing a plurality of freely-movable, unrestrained bodies, means for generating a force by expansion of a gas in an expander region of said second passageway to propel successive ones of the bodies in one direction around the second passageway, a compression region in said second passageway beyond the expander region wherein fluid is compressed between successive ones of the propelled bodies, port means in the second passageway between the end of the expander region and the beginning of the compression region to permit the venting of fluid which has been expanded and the extrance of fluid which is to be compressed, heat exchanger means having its entrance connected to the second passageway at the end of the compression region and its exit connected to the second passageway at the beginning of the expander region, wherein heat is introduced into the portion of said compressed fluid traversing the heat exchanger and the heated, compressed fluid is then introduced into the expander region, means to convey a portion of the compressed fluid from the end of the compression region of the second passageway to the beginning of the expander region of the first passageway, and a thruster region in the second passageway beyond the compression region wherein an external force is applied to successive ones of said bodies to counterbalance the external forces acting against the bodies as they traverse the loop passageway and to return them from the end of the compression region to the beginning of the expander region.

11. The heat pump apparatus of claim 10 wherein said first-mentioned continuous loop passageway includes at least two of said heat pumps connected in series, and wherein said second-mentioned passageway includes at least two of said compressors connected in series, and wherein means are provided for conveying a portion of the compressed fluid from the end of the compression region of each compressor in the second passageway to the beginning of the expander region in an associated heat pump in the first-mentioned passageway.

12. The heat pump apparatus of claim 1 wherein said fluid is a gas or a liquefiable vapor.

13. The heat pump apparatus of claim 1 wherein said passageway is oriented such that the force acting on said bodies in the thruster region is the force of gravity.

14. The heat pump apparatus of claim 1 wherein the temperature of the fluid vented from said port means is lower than that of the fluid entering said port means.

15. The heat pump apparatus of claim 1 wherein there is substantially no drop in the pressure of said fluid as it passes through the heat exchanger.

16. The heat pump apparatus of claim 1 further comprising means to prevent backward motion of said bodies in the compression region of said continuous loop passageway after reducing kinetic energy of the bodies.

17. Heat pump apparatus comprising:

(a) a continuous loop passageway containing a plurality of bodies to move along the passageway, (b) means for generating a force by expansion of fluid in an expander region of said passageway to thereby propel the bodies in one direction around the passageway, (c) a compression region in the passageway beyond the expander region wherein fluid is compressed between successive ones of the propelled bodies, (d) port means in the passageway between the expander region and the compression region to permit the venting of fluid which has been expanded in the expander region and the entrance of fluid which is to be compressed in the compression region, (e) heat exchanger means connected to the passageway at the compression region for extracting heat from the fluid thus compressed, and (f) a thruster region between the compression region and the expander region.

18. The heat pump apparatus of claim 17 wherein said heat exchanger means is connected to the passageway at the end of the compression region.

19. The heat pump apparatus of claim 17 further comprising means to prevent backward motion of said bodies in the compression region of said continuous loop passageway after reducing kinetic energy of the bodies.

20. A method for increasing the heat content of a fluid and thereafter transferring the heat content to an ambient atmosphere, which comprises the steps of:

(a) providing a closed-continuous loop passageway containing a plurality of bodies to move along the passageway, (b) generating a force between successive ones of said bodies by expansion of fluid in an expander region of said passageway to increase the kinetic energy of the bodies and thereby propel successive ones of the bodies in one direction around the passageway, (c) exiting said fluid after expansion thereof from the interior of said passageway at a reduced temperature, (d) introducing a fluid at a temperature higher than said reduced temperature into the interior of said passageway and thereafter compressing said introduced fluid between successive ones of the bodies propelled by expansion, and (e) thereafter passing the compressed fluid through heat exchanger means connected to the passageway after compression of said fluid for extracting heat from the fluid thus compressed.

21. The method of claim 20 wherein step (e) is further defined to include passing the compressed fluid through heat exchanger means coupled to the passageway at the completion of compression of said fluid.

22. The method of claim 20 including the step of passing the compressed fluid after passage through said heat exchanger means back into said passageway to propel successive ones of the bodies in one direction around the passageway.

23. The method of claim 20 including the step of adding additional compressed fluid to the fluid passing through said heat exchanger means prior to introducing the mixture thereto into said passageway for expansion thereof.

24. The method of claim 20 wherein steps (b), (c), (d) and (e) are repeated at least twice as said unrestrained bodies move around said continuous loop passageway.

25. The method of claim 20 wherein said fluid is air, and said air is passed through a heat exchanger means within a building and air is introduced and exited from the continuous loop passageway exterior to the building.

26. The method of claim 20 wherein said fluid is air which is passed through heat exchanger means external to a building and air exits and is introduced into said continuous loop passageway within the interior of the building.

27. The method of claim 20 comprising the further step of preventing backward motion of said bodies in the compression region of said continuous loop passageway after reducing kinetic energy of the bodies.

28. Heat pump apparatus comprising:

(a) a continuous loop passageway containing a plurality of bodies to move along said passageway, said continuous loop passageway including two vertical passageway sections with successive ones of said bodies moving upwardly against the force of gravity along one vertical section and thence downwardly under the force of gravity along the other vertical passageway section, (b) means for generating a force by expansion of fluid in an expander region in each of said two vertical passageway sections to thereby accelerate successive ones of the bodies in one direction around the passageway, (c) a compression region in each of said two vertical passageway sections beyond the expander region thereof to compress fluid between successive ones of the propelled bodies, (d) port means in the passageway between the end of each expander region and the beginning of the compression region therebeyond to permit the venting of fluid which has been expanded and the entrance of fluid which is to be compressed, (e) a thruster region beyond each compression region in the passageway wherein a force is applied to successive ones of the bodies to counterbalance the external forces acting against the bodies as they traverse the passageway and to feed them from the end of one compression region to the beginning of an expander region, and (f) heat exchanger means having its entrance connected to the passageway at the end of each compression region to extract heat from the compressed fluid leaving each compression region.

29. The heat pump apparatus of claim 28 wherein each thruster region includes a generally U-shaped section of passageway extending between said two vertical passageway sections to conduct successive ones of said bodies from one vertical section to the other vertical section.

30. The heat pump apparatus of claim 29 wherein each thruster region further includes means to impart a net external force to successive ones of said bodies while moving along each thruster region.

31. The heat pump apparatus according to claim 30 wherein said means to impart a net external force includes a sprocket wheel with members extending into said passageway to engage successive ones of said bodies while moving along the thruster region, synchronizing drive means rotatably coupling together the sprocket wheels at the thruster regions.

32. The heat pump apparatus according to claim 28 wherein each of said bodies has a hollow cylindrical shape substantially complementary to the cross-sectional shape of said continuous loop passageway.

33. The heat pump apparatus according to claim 32 wherein the hollow cylindrical shape of each of said bodies defining a piston has a convex end surface leading the piston in its direction of travel and a concave end surface trailing the piston in its direction of travel.

34. The heat pump apparatus according to claim 32 wherein said piston forming each of said bodies includes spaced-apart ring members to substantially seal the passageway from fluid flow around said piston.

* * * * *